US008006766B2

(12) United States Patent
Zarowny et al.

(10) Patent No.: US 8,006,766 B2
(45) Date of Patent: Aug. 30, 2011

(54) METHOD AND APPARATUS FOR CONTROLLING THE SPEED OF A PUMP IN A WELL

(75) Inventors: Cameron Zarowny, Streamstown (CA); Wayne Muir, Lloydminster (CA); Wendell Young, Lloydminster (CA)

(73) Assignee: Noralta Technologies Inc., Lloydminster (CA)

( * ) Notice: Subject to any disclaimer, the term of this patent is extended or adjusted under 35 U.S.C. 154(b) by 231 days.

(21) Appl. No.: 11/450,188

(22) Filed: Jun. 8, 2006

(65) Prior Publication Data

US 2006/0278386 A1 Dec. 14, 2006

(30) Foreign Application Priority Data

Jun. 8, 2005 (CA) ..... 2510101

(51) Int. Cl.
*E21B 43/12* (2006.01)

(52) U.S. Cl. ..... 166/369; 166/53; 417/36; 417/43

(58) Field of Classification Search ..... 166/369, 166/53; 417/36, 38, 43; 73/302, 291, 290 R
See application file for complete search history.

(56) References Cited

U.S. PATENT DOCUMENTS

| | | | | |
|---|---|---|---|---|
| 4,854,164 | A * | 8/1989 | Rhoads | 73/152.29 |
| 5,782,608 | A | 7/1998 | McKee | |
| 5,984,641 | A | 11/1999 | Bevan et al. | |
| 6,237,410 | B1 | 5/2001 | Dyck et al. | |
| 6,817,419 | B2 * | 11/2004 | Reid | 166/369 |
| 2004/0065477 | A1 * | 4/2004 | Paulk et al. | 175/50 |
| 2004/0149436 | A1 * | 8/2004 | Sheldon | 166/250.15 |
| 2005/0013697 | A1 | 1/2005 | Bevan et al. | |
| 2006/0204365 | A1 * | 9/2006 | Bevan et al. | 417/18 |

FOREIGN PATENT DOCUMENTS

| | | | |
|---|---|---|---|
| CA | 2 240 606 | A1 | 12/1999 |
| CA | 2 146 096 | C | 1/2002 |

* cited by examiner

*Primary Examiner* — Shane Bomar
*Assistant Examiner* — Brad Harcourt
(74) *Attorney, Agent, or Firm* — Christensen O'Connor Johnson Kindness PLLC

(57) ABSTRACT

A method and apparatus for controlling a speed of a pump operating in a well. A first step involves monitoring a production flow rate of fluids produced from the well. A second step involves controlling the speed of the pump with reference to the production flow rate by increasing the speed of the pump when the production flow rate is rising and decreasing the speed of the pump when the production flow rate is declining.

3 Claims, 1 Drawing Sheet

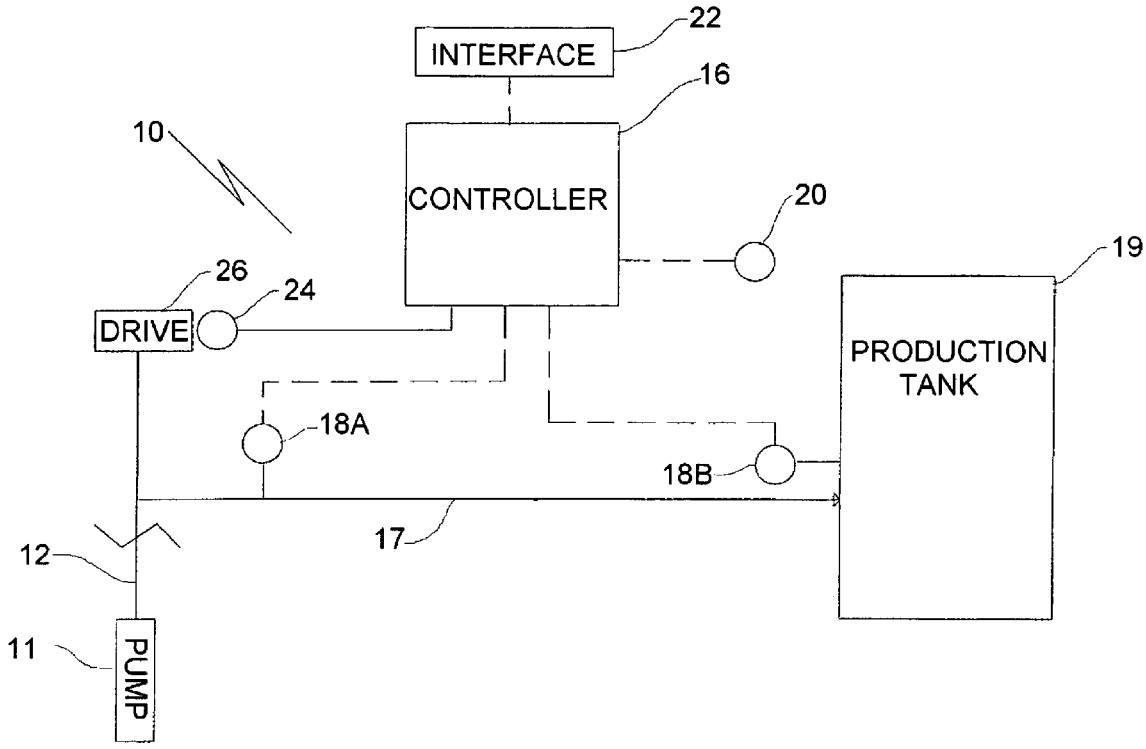
THE FIGURE

METHOD AND APPARATUS FOR CONTROLLING THE SPEED OF A PUMP IN A WELL

FIELD OF THE INVENTION

The present invention relates to a method and associated apparatus for controlling the speed of a pump in a well.

BACKGROUND OF THE INVENTION

U.S. Pat. No. 6,237,410 (Dyck et al 2001) discloses a method and an apparatus for controlling the speed of a pump in a well. The teachings of the Dyck et al patent are to control the speed of the pump based upon acoustic measurement of the fluid depth in a well.

SUMMARY OF THE INVENTION

According to one aspect of the present invention there is provided a method for controlling a speed of a pump in a well. A first step involves monitoring a production flow rate of fluids produced from the well. A second step involves continually varying the speed of the pump in reference to the production flow rate by increasing the speed of the pump when the production flow rate is rising and decreasing the speed of the pump when the production flow rate is declining.

According to another aspect of the present invention there is provided an apparatus for controlling a speed of a pump operating in a well, which includes a controller and a sensor in communication with the controller. The sensor monitors a production flow rate of fluids produced from the well and provides production flow rate data to the controller. A pump speed control device is provided which is in communication with both the pump and the controller. The controller sends signals to the pump speed control device to increase the speed of the pump by user configurable increments when the production flow rate data from the sensor indicates that the production flow rate is rising and decrease the speed of the pump by user configurable increments when the production flow rate data from the sensor indicates that the production flow rate is declining.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein:

THE FIGURE is a schematic diagram of an apparatus for controlling the speed of a pump in a well constructed in accordance with the teachings of the present invention.

DETAILED DESCRIPTION OF THE PREFERRED EMBODIMENT

The preferred embodiment, an apparatus generally identified by reference numeral 10, will now be described with reference to THE FIGURE.

Structure and Relationship of Parts:

Referring to THE FIGURE, there is shown apparatus 10 for controlling the speed of a pump 11 operating in a well 12, including a controller 16 and sensors 18A and 18B in communication with controller 16. Sensors 18A and 18B monitor a production flow rate of fluids produced from well 12 and provides production flow rate data to controller 16. The monitoring function can be performed at pre-selected time intervals or continuously. It is preferred that the monitoring function be performed continuously. As depicted, the flow rate is measured by sensor 18A as the fluid pass along flow line 17 to production tank 19, and by sensor 18B at production tank 19. There is also a pump speed control device 20 in communication with pump 11 and in communication with controller 16. When the production flow rate data from sensors 18A and 18B indicates that the production flow rate is rising, controller 16 sends signals to pump speed control device 20 to increase the speed of pump 11 by user configurable increments. When the production flow rate data from sensors 18A and 18B indicate that the production flow rate is declining, controller 16 sends signals to pump speed control device 20 to decrease the speed of pump 11 by user configurable increments. As pump 11 is depicted as being driven by a wellhead drive 26. In is case, the signal from pump speed control device 20 is sent to wellhead drive 26. An operator interface 22 is provided which displays the production flow rate data, including pump speed data, as measured by a pump speed sensor 24.

Operation:

Referring to THE FIGURE, the method for controlling the speed of a pump 11 operating in a well 12 includes monitoring the production flow rate of fluids produced from the well. The speed of pump 11 is controlled with reference to the production flow rate by increasing the speed of pump 11 by user configurable increments when the production flow rate is rising and decreasing the speed of pump 11 by user configurable increments when the production flow rate is declining. The speed of pump 11 as detected by pump speed sensor 24 may be displayed on operator interface 22.

Advantages:

The present invention continually optimizes well production by monitoring the production flow rate while protecting the pump from low flow conditions to prevent pump damage. The production flow rate is used to determine whether and how the controller will adjust the speed of the pump. A decrease in production flow will cause the controller to slow down the pump speed until the flow returns in the well. Once the flow returns, the pump will begin to speed up. The frequency and magnitude of the speed up and slow down cycle is user configurable. Limits for minimum and maximum speed are also user configurable. Data viewing and configuration can be done through a local HMI and/or remotely via SCAD. Hourly and daily production calculations are performed based on the level of the production tank, which may be determined by a level sensor, for statistical analysis by operations and/or engineering. Hourly and daily efficiency calculations may be performed by utilizing the actual pump production, motor RPM readings, and pump size data for statistical analysis. Other patents vary the pump rate based on fluid level within the well bore. This invention optimizes well production based on well bore production flow independent of fluid level.

In this patent document, the word "comprising" is used in its non-limiting sense to mean that items following the word are included, but items not specifically mentioned are not excluded. A reference to an element by the indefinite article "a"does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. An apparatus for controlling a speed of a pump operating in a well, comprising:

a controller;

a sensor in communication with the controller, the sensor monitoring a production flow rate of a continuous flow of fluids produced from the well based upon a series of level readings at regular intervals over time indicating a rate of rise in a production tank and providing production flow rate data to the controller; and a pump speed control device in communication with the pump and in communication with the controller, the controller sending signals to the pump speed control device to increase the speed of the pump by user configurable increments when the production flow rate data from the sensor indicates that the production flow rate is rising and decrease the speed of the pump by user configurable increments when the production flow rate data from the sensor indicates that the production flow rate is declining.

2. The apparatus as defined in claim 1, wherein an operator interface is provided which displays the production flow rate data.

3. The apparatus as defined in claim 2, wherein the operator interface displays pump speed data.

* * * * *